US007228966B1

(12) United States Patent
Turner

(10) Patent No.: US 7,228,966 B1
(45) Date of Patent: Jun. 12, 2007

(54) PORTABLE LIPSTICK CARRYING CASE

(76) Inventor: Darlene Turner, 66-1676 Wai'aka St., Kamuela, HI (US) 96743

( * ) Notice: Subject to any disclaimer, the term of this patent is extended or adjusted under 35 U.S.C. 154(b) by 373 days.

(21) Appl. No.: 10/840,460

(22) Filed: May 7, 2004

(51) Int. Cl.
*B65D 85/72* (2006.01)
*B65D 25/06* (2006.01)
*A45D 40/24* (2006.01)

(52) U.S. Cl. ..... 206/385; 206/581; 220/532; 132/315

(58) Field of Classification Search ..... 206/581, 206/235, 372, 373, 443, 446, 385, 37, 815, 206/823; 132/314–318; 220/529, 532, 533, 220/676, 507, 526, 555, 665, 523; 43/54.1; D28/85, 86
See application file for complete search history.

(56) References Cited

U.S. PATENT DOCUMENTS

| | | | | | |
|---|---|---|---|---|---|
| 2,497,314 | A | | 2/1950 | Libson | |
| 2,695,112 | A | * | 11/1954 | Bonnevay | 206/523 |
| D199,111 | S | | 9/1964 | Hollins | |
| 3,239,069 | A | | 3/1966 | Hollins | |
| D243,124 | S | * | 1/1977 | Horowitz | D28/85 |
| 4,422,545 | A | | 12/1983 | Kadoory | |
| 4,807,760 | A | * | 2/1989 | Sussman | 206/581 |
| D303,024 | S | | 8/1989 | Zall | |
| 4,858,765 | A | | 8/1989 | Nakamura et al. | |
| 5,267,650 | A | * | 12/1993 | Gilbilisco | 206/534 |
| 5,277,308 | A | * | 1/1994 | Finke et al. | 220/665 |
| 5,398,706 | A | | 3/1995 | Epstein | |
| 5,441,153 | A | | 8/1995 | Lahaye | |
| 5,542,637 | A | * | 8/1996 | Schriner | 206/576 |
| 5,586,653 | A | * | 12/1996 | Taveroff | 206/362 |
| 5,860,550 | A | * | 1/1999 | Miller et al. | 206/535 |
| 5,894,928 | A | * | 4/1999 | Chang | 220/665 |
| 6,167,680 | B1 | * | 1/2001 | Horn | 206/776 |
| D469,579 | S | | 1/2003 | Thorpe et al. | |
| 6,644,488 | B1 | * | 11/2003 | Coleman | 220/524 |

* cited by examiner

*Primary Examiner*—Mickey Yu
*Assistant Examiner*—J. Gregory Pickett

(57) ABSTRACT

A carrying case for transporting personal hygiene products includes at least one chamber having a pivotal door and including a first section having at least one divider for adjusting a length of the section. The door includes a first portion formed from opaque material and a second portion formed from transparent material and the chamber includes a second section oppositely spaced from the first section. In an alternate embodiment, the present invention includes a compartment for lip liners. In another embodiment, the present invention includes a lid formed from reflective material for assisting a user to in applying makeup.

14 Claims, 4 Drawing Sheets

PORTABLE LIPSTICK CARRYING CASE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a cosmetic case and, more particularly, to a transparent portable lipstick carrying case that may be used to carry multiple tubes of lipstick.

2. Prior Art

The use of cosmetic cases is known in the prior art. More specifically, cosmetic cases heretofore devised and utilized for the purpose of holding cosmetics are known to consist basically of familiar, expected and obvious structural configurations, notwithstanding the myriad of designs, which have been developed for the fulfillment of countless objectives and requirements. While these devices fulfill their respective, particular objectives and requirements, a lipstick case for containing a plurality of tubes of lipstick to organize and effectively protect the lipstick while being carried in a handbag is hard to come by.

In general, lipstick and mascara are encased in similar stick-type cases of similar sizes. Therefore, when a number of these stick-type case-encased cosmetics are put individually in a pocketbook, it is difficult and troublesome to find a particular cosmetic among the others. The plastic cosmetic bag cannot hold the cosmetic cases in organized manner, and moreover, is not convenient to handle since it is flexible. The plastic box enables the cosmetic tubes or cases to be arranged neatly, however, is not convenient to handle either since such a box serves not only as a container for lipstick tubes but also as a cap for the lipstick tubes. More specifically, almost the entire lipstick tube must be inserted into the box in order to put each of the tubes in the box, while the lipstick tube must be pulled out in order to take each of the tubes out of the box.

Holders for cosmetic sticks such as lipsticks or similar soft solid materials formed by molding or extrusion frequently have transparent covers, and are constructed so that the tip of the lipstick will be visible through the transparent cover, even when the lipstick is fully retracted into the holder. This is accomplished by locating the elevator cup holding the lipstick at a predetermined height in the holder. While such design permits display of the lipstick being used and enables the user to see the actual color without having to remove the cover, it is sometimes the situation that the true color is not as clearly seen as would be desired.

Accordingly, a need remains for a transparent portable lipstick carrying case that holds multiple tubes of lipstick and overcomes the above-noted shortcomings.

BRIEF SUMMARY OF THE INVENTION

In view of the foregoing background, it is therefore an object of the present invention to provide a portable lipstick carrying case. These and other objects, features, and advantages of the invention are provided by an adjustable carrying case for transporting personal hygiene products that includes at least one chamber with a longitudinal axis extending along a substantially horizontal plane and a door pivotally connected thereto.

In a preferred embodiment, the at least one chamber includes a first section provided with a plurality of grooves and at least one divider member slidably insertable into corresponding ones of the grooves for selectively adjusting a length of the first section. The at least one chamber further includes a plurality of aligned arcuate recesses extending rearwardly and orthogonal to the axis so that a user can readily access an object disposed within the at least one chamber.

Such a chamber further includes a collar that has an arcuate portion for receiving a lipstick tube and further has a ridge portion extending substantially perpendicular to the axis for restraining longitudinal movement of a lipstick tube.

The present invention further includes a door that includes a plurality of tabs extending outwardly therefrom and positionable within the plurality of recesses for preventing foreign objects from entering the at least one chamber when the door is at a closed position.

Advantageously, the present invention further includes a mechanism for selectively locking the door to the at least one chamber. Such a locking mechanism preferably includes a handle with a latch for engaging a select portion of the second section. Of course, other well known locking mechanisms making be employed such as VELCRO, for example, without departing from the true scope of the invention. Such a door includes a first portion and a second portion integral therewith. Such a first portion is formed from opaque material and the second portion is formed from transparent material for preventing and allowing a user to see within the at least one chamber respectively when the door is at a closed position.

In an alternate embodiment, the at least one chamber further includes a second section oppositely spaced from the first section and including a plurality of integral walls formed from transparent material so that a user can identify a color of lipstick when the door is at a closed position.

In another embodiment, the present invention further includes a compartment connected to the at least one chamber for providing an elongated section for receiving and storing lip liners therein.

In yet another embodiment, the present invention advantageously includes a lid pivotally connected to the at least one chamber and movable between raised and lowered positions. Such a lid is formed from a reflective material for assisting a user to accurately apply makeup.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
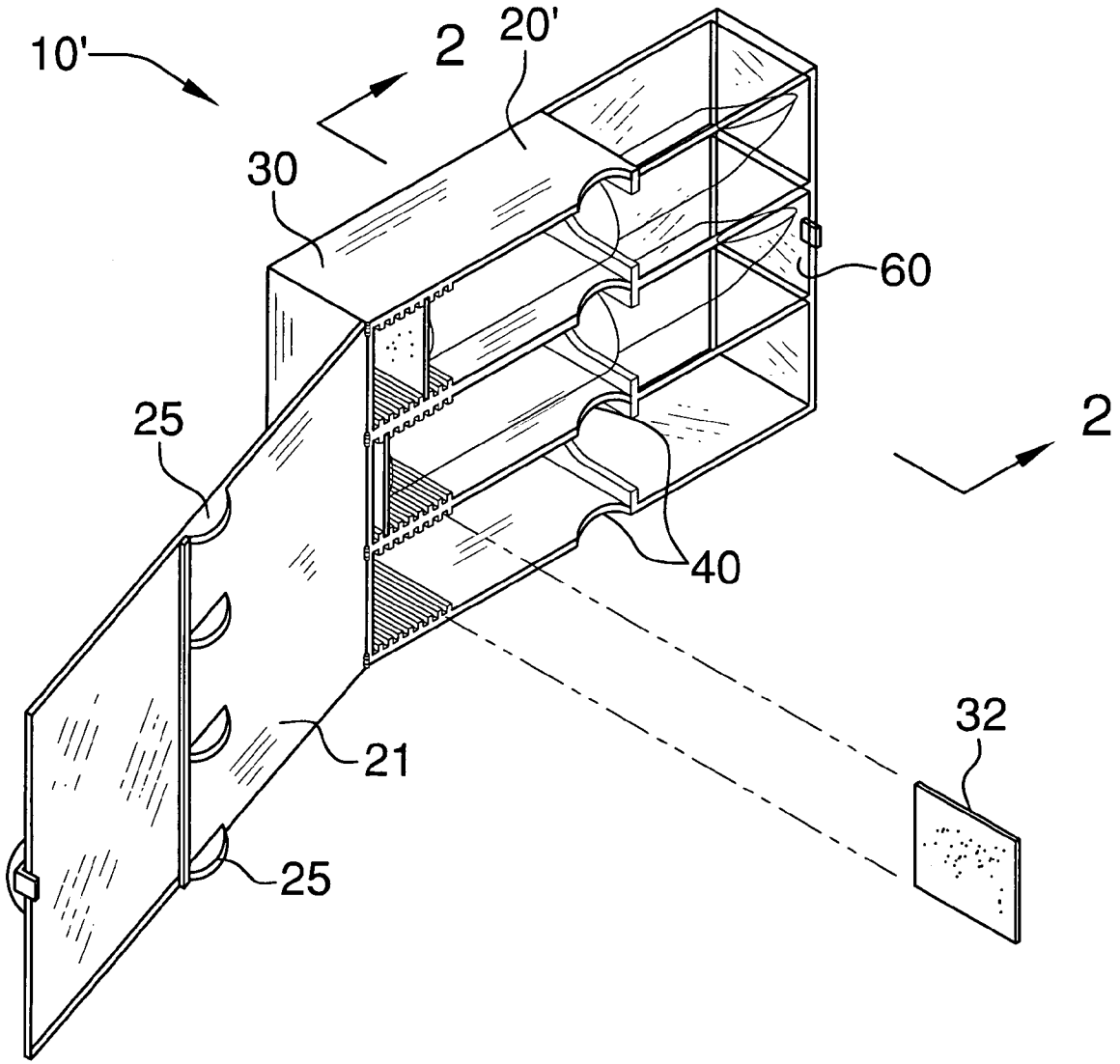
FIG. 1 is a perspective view showing a portable lipstick carrying case for holding multiple tubes of lipstick, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures. Prime/double prime notations refer to alternate embodiments of like elements.

The apparatus of this invention is referred to generally in FIGS. 1-5 by the reference numeral 10 and is intended to hold and protect cosmetic products. It should be understood that the apparatus 10 may be used to carry many different types of cosmetic products and should not be limited to carrying out lipstick or mascara.

Figure 3:
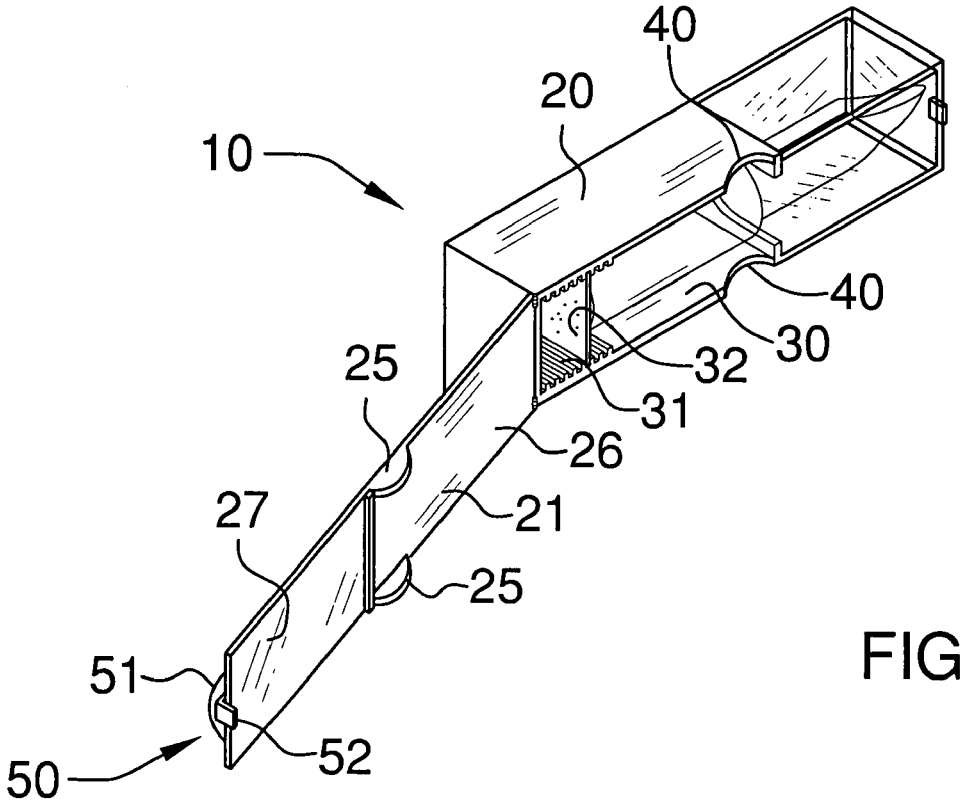
FIG. 3 is a perspective view showing an alternate embodiment of the present invention.

Referring initially to FIG. 3, the apparatus 10 includes at least one chamber 20 with a longitudinal axis extending along a substantially horizontal plane and a door 21 pivotally connected thereto. In a preferred embodiment 10, the chamber 20 includes a first section 30 provided with a plurality of grooves 31 and at least one divider member 32 slidably insertable into corresponding ones of the grooves 31 for selectively adjusting a length of the first section 30. The chamber 20 further includes a plurality of aligned arcuate recesses 40 extending rearwardly and orthogonal to the axis so that a user can readily access an object disposed within the at least one chamber 20.

Figure 2:
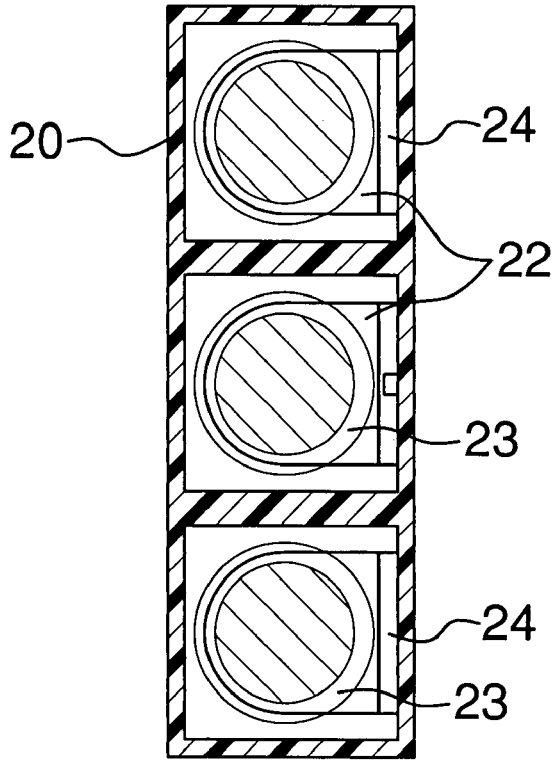
FIG. 2 is an enlarged cross-sectional view of the present invention shown in FIG. 1, taken along line 2-2.

Referring to FIG. 2, such a chamber 20 further includes a collar 22 that has an arcuate portion 23 for receiving a lipstick tube and further has a ridge portion 24 extending substantially perpendicular to the axis for restraining longitudinal movement of the lipstick tube. Advantageously, the cosmetic items can be maintained at substantially stable positions within the apparatus 10.

Figure 4:
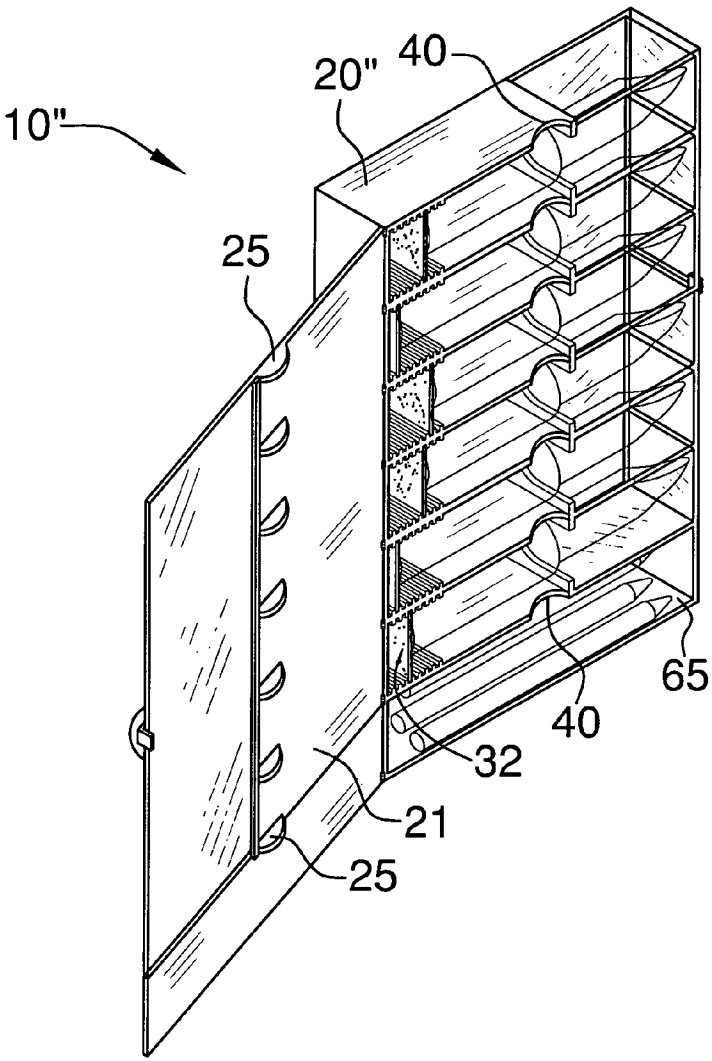
FIG. 4 is a perspective view showing another embodiment of the present invention.

Now referring to FIGS. 1, 3, and 4, the present invention further includes a door 21 that includes a plurality of tabs 25 extending outwardly therefrom and positionable within the plurality of recesses 40 for preventing foreign objects from entering the at least one chamber 20 when the door 21 is at a closed position.

Advantageously, the present invention further includes a mechanism 50 for selectively locking the door 21 to the at least one chamber 20. Such a locking mechanism 50 preferably includes a handle 51 with a latch 52. Of course, other well known locking mechanisms 50 may be employed such as VELCRO, for example, without departing from the true scope of the invention. Such a door 21 includes a first portion 26 and a second portion 21 integral therewith. The first portion 26 is formed from opaque material and the second portion 27 is formed from transparent material for preventing and allowing a user to see within the at least one chamber 20, respectively, when the door 21 is at a closed position. Being able to see the colors of lipstick, for example, through the carrying case will allow a user to quickly select a preferred color without rummaging through a purse, for example.

Similarly, the chamber 20' of embodiment 10' further includes a second section 60 oppositely spaced from the first section 30 and is provided with a plurality of integral walls 61 formed from transparent material so that a user can identify a color of lipstick when the door 21 is at a closed position, as perhaps best shown in FIG. 1.

Referring to FIG. 4, another embodiment 10" of the present invention further includes a compartment 65 connected to chamber 20" for providing an elongated section for receiving and storing lip liners therein.

Figure 5:
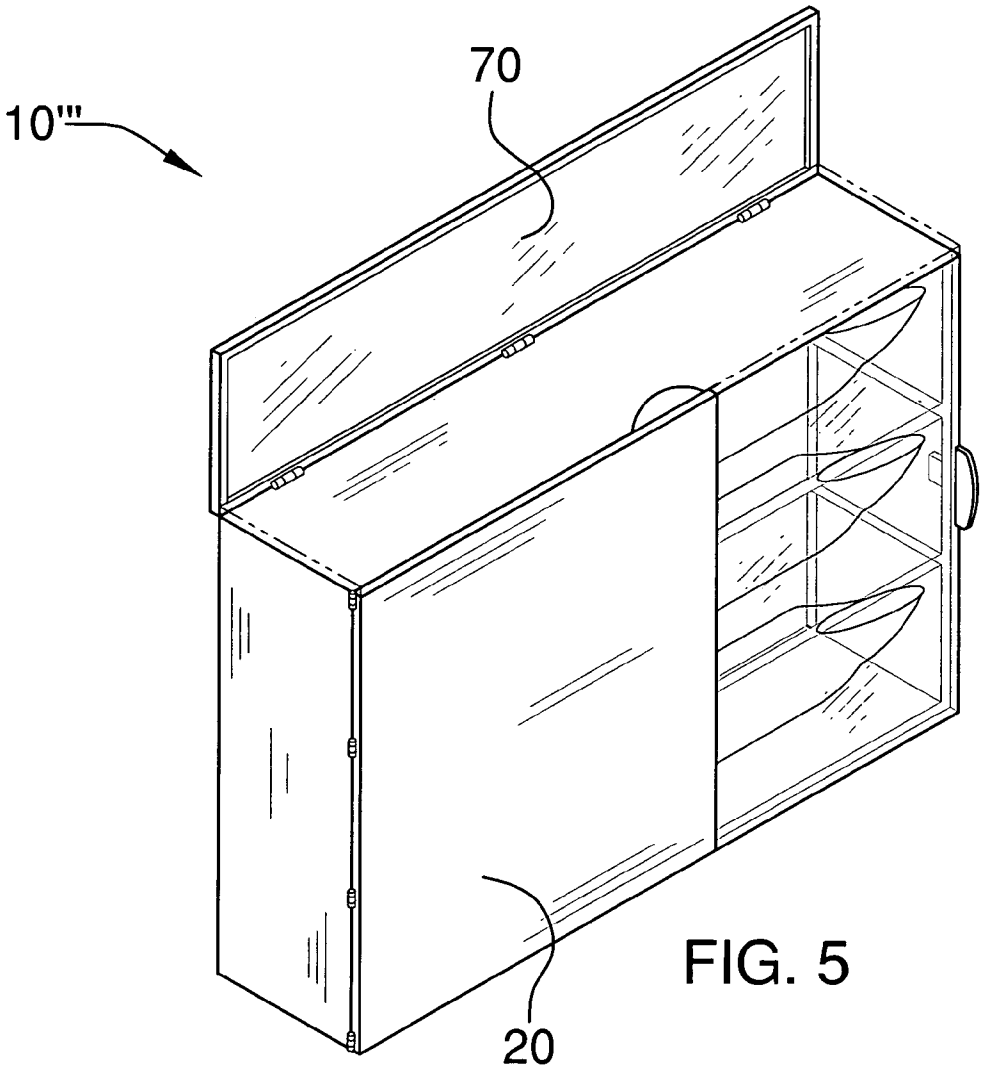
FIG. 5 is a perspective view showing yet another embodiment of the present invention.

Referring to FIG. 5, yet another embodiment 10''' of the present invention advantageously includes a lid 70 pivotally connected to chamber 20 and is movable between raised and lowered positions. Such a lid 70 is formed from a reflective material for assisting a user to accurately apply makeup.

Most women carry cosmetic products in a flexible makeup bag or just let them float around loosely in a purse. Often times, this leads to broken colored pencils, melted lipsticks, and spilled powder. The present invention provides an attractive way to carry makeup products in a hard case that will protect these products. The transparent lid will save a user the time and energy that is spent fumbling around for the right color of lipstick or blush, for example.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An adjustable carrying case for transporting personal hygiene products, said carrying case comprising:

a plurality of chambers having a longitudinal axis extending along a substantially horizontal plane and comprising a door pivotally connected thereto, said a plurality of chambers further comprising a first section provided with a plurality of grooves and at least one divider member slidably insertable into corresponding ones of said grooves for selectively adjusting a length of said first section, said a plurality of chambers further including a plurality of aligned arcuate recesses extending rearwardly and orthogonal to the axis so that a user can readily access an object disposed within said a plurality of chambers, said door comprising a plurality of tabs extending outwardly therefrom and being positionable within the plurality of recesses for preventing foreign objects from entering said at least one chamber when said door is at a closed position, said tabs being centrally and vertically aligned along an interior surface of said door and remaining spaced from opposed sides of said a plurality of chambers when said door is pivoted to the closed position; and means for selectively locking said door to said a plurality of chambers.

2. The carrying case of claim 1, wherein said a plurality of chambers further comprises: a collar having an arcuate portion for receiving a lipstick tube and further having a ridge portion extending substantially perpendicular to the axis for restraining longitudinal movement of a lipstick tube, said collar extending inwardly towards a rear side of said a plurality of chambers.

3. The carrying case of claim 1, wherein said a plurality of chambers further comprises: a second section oppositely spaced from said first section and including a plurality of integral walls formed from transparent material so that a user can identify a color of lipstick when said door is at a closed position.

4. The carrying case of claim 1, further comprising: a compartment connected to said a plurality of chambers and for providing an elongated section for receiving and storing lip liners therein.

5. The carrying case of claim 1, wherein said door comprises: a first portion and a second portion integral therewith, said first portion being formed from opaque material and said second portion being formed from transparent material for preventing and allowing a user to see within said a plurality of chambers respectively when said door is at a closed position.

6. The carrying case of claim 3, wherein said locking means comprises: a handle including a latch for engaging a select portion of said second section.

7. The carrying case of claim 1, further comprising a lid pivotally connected to said a plurality of chambers and movable between raised and lowered positions, said lid being formed from a reflective material for assisting a user to accurately apply makeup.

8. An adjustable carrying case for transporting personal hygiene products, said carrying case comprising:

a plurality of chambers having a longitudinal axis extending along a substantially horizontal plane and comprising a door pivotally connected thereto, said a plurality of chambers further comprising a first section provided with a plurality of grooves and at least one divider member slidably insertable into corresponding ones of said grooves for selectively adjusting a length of said first section, said a plurality of chambers further including a plurality of aligned arcuate recesses extending rearwardly and orthogonal to the axis so that a user can readily access an object disposed within said a plurality of chambers, said door comprising a plurality of tabs extending outwardly therefrom and being positionable within the plurality of recesses for preventing foreign objects from entering said a plurality of chambers when said door is at a closed position; and means for selectively locking said door to said a plurality of chambers;

said a plurality of chambers further comprising a collar having an arcuate portion for receiving a lipstick tube and further having a ridge portion extending substantially perpendicular to the axis for restraining longitudinal movement of a lipstick tube;

wherein said tabs are centrally and vertically aligned along an interior surface of said door and remain spaced from opposed sides of said a plurality of chambers when said door is pivoted to the closed position.

9. The carrying case of claim 8, wherein said a plurality of chambers further comprises: a second section oppositely spaced from said first section and including a plurality of integral walls formed from transparent material so that a user can identify a color of lipstick when said door is at a closed position.

10. The carrying case of claim 8, further comprising: a compartment connected to said a plurality of chambers and for providing an elongated section for receiving and storing lip liners therein.

11. The carrying case of claim 8, wherein said door comprises: a first portion and a second portion integral therewith, said first portion being formed from opaque material and said second portion being formed from transparent material for preventing and allowing a user to see within said a plurality of chambers respectively when said door is at a closed position.

12. The carrying case of claim 9, wherein said locking means comprises: a handle including a latch for engaging a select portion of said second section.

13. The carrying case of claim 8, further comprising a lid pivotally connected to said a plurality of chambers and movable between raised and lowered positions, said lid being formed from a reflective material for assisting a user to accurately apply makeup.

14. An adjustable carrying case for transporting personal hygiene products, said carrying case comprising:

a plurality of chambers having a longitudinal axis extending along a substantially horizontal plane and comprising a door pivotally connected thereto, said plurality of chambers further comprising a first section provided with a plurality of grooves and at least one divider member slidably insertable into corresponding ones of said grooves for selectively adjusting a length of said first section, said plurality of chambers further including a plurality of aligned arcuate recesses extending rearwardly and orthogonal to the axis so that a user can readily access an object disposed within said plurality of chambers, said door comprising a plurality of tabs extending outwardly therefrom and being positionable within the plurality of recesses for preventing foreign objects from entering said plurality of chambers when said door is at a closed position; and means for selectively locking said door to said plurality of chambers;

said plurality of chambers further comprising a collar having an arcuate portion for receiving a lipstick tube and further having a ridge portion extending substantially perpendicular to the axis for restraining longitudinal movement of a lipstick tube;

said plurality of chambers further comprising a second section oppositely spaced from said first section and including a plurality of integral walls formed from transparent material so that a user can identify a color of lipstick when said door is at a closed position;

wherein said plurality of chambers are coextensively shaped and are vertically stacked;

wherein a top side of a bottom one of said plurality of chambers defines a bottom side of a top one of said plurality of chambers;

wherein said grooves are formed along top and bottom sides of selected ones of said plurality of chambers such that corresponding ones of said grooves extend orthogonal to the longitudinal axis;

wherein said arcuate regions are vertically registered and spaced along said top and bottom sides of said selected chambers respectively;

wherein said door further includes a linear ridge vertically oriented adjacent to said tabs and disposed along an inner surface of said door, said ridge extending from a top edge to a bottom edge of said door and laying contiguously with said arcuate regions when said door is pivoted to the closed position;

wherein each of said top and bottom sides are formed from solid material and are vertically spaced apart, said top and bottom sides extend parallel to a ground surface and terminate generally midway along the longitudinal length of said plurality of chambers respectively;

wherein said door has a vertical height equal to total vertical height of said plurality of chambers.

* * * * *